US005895060A

United States Patent [19]

Marchesin et al.

[11] Patent Number: 5,895,060

[45] Date of Patent: Apr. 20, 1999

[54] ROLLER SKATE

[75] Inventors: Bruno Marchesin, Seren Del Grappa; Alessandro Pozzobon, Paderno Di Ponzano Veneto; Carlo Guerrera, Pordenone, all of Italy

[73] Assignee: Nordica, S.p.A., Trevignano, Italy

[ * ] Notice: This patent is subject to a terminal disclaimer.

[21] Appl. No.: 08/770,598

[22] Filed: Dec. 19, 1996

[30] Foreign Application Priority Data

Dec. 22, 1995 [IT] Italy ..... TV95A0165

[51] Int. Cl.[6] ..... A63C 17/14

[52] U.S. Cl. ..... 280/11.2; 188/5

[58] Field of Search ..... 188/2 D, 5; 280/11.2, 280/11.22, 11.23

[56] References Cited

U.S. PATENT DOCUMENTS

| | | | |
|---|---|---|---|
| 5,388,844 | 2/1995 | Pellegrini, Jr. et al. | 280/11.2 |
| 5,397,137 | 3/1995 | Pellegrini, Jr. et al. | 280/11.22 |
| 5,411,276 | 5/1995 | Moldenhauer | 280/11.2 |
| 5,415,419 | 5/1995 | Bourque | 280/11.2 |
| 5,439,238 | 8/1995 | Neal | 280/11.2 |
| 5,465,984 | 11/1995 | Pellegrini et al. | 280/11.2 |
| 5,486,012 | 1/1996 | Oliveri | 280/11.2 |

FOREIGN PATENT DOCUMENTS

| | | |
|---|---|---|
| 0 567 948 | 11/1993 | European Pat. Off. . |
| 0 600 274 | 6/1994 | European Pat. Off. . |
| 0 656 221 | 6/1995 | European Pat. Off. . |
| 0 694 321 | 1/1996 | European Pat. Off. . |
| 9 624 414 | 8/1996 | WIPO . |

*Primary Examiner*—J. J. Swann
*Assistant Examiner*—Michael Mar
*Attorney, Agent, or Firm*—Hale and Dorr LLP

[57] ABSTRACT

A roller skate including a quarter pivoted to a shell connected to a frame supporting wheels; a brake pad is supported by a support; a cable guides a flexible actuator adapted to actuate the support upon a rearward rotation of the quarter with respect to the shell.

11 Claims, 6 Drawing Sheets

ROLLER SKATE

BACKGROUND OF THE INVENTION

The present invention relates to a roller skate having a braking device.

Conventional skates are sometimes provided with a braking device constituted by an adapted block or pad, usually made of rubber, arranged at the toe or heel region of the skate; when the user tilts the skate forwards or backwards, the pad interacts with the ground and braking is thus achieved.

However, this braking device is not ideal, because the user has to rotate the skate, and this can cause loss of balance and consequent falls.

U.S. Pat. No. 5,465984 discloses a braking device for skates, comprising a shoe composed of a quarter that is articulated to a shell that is in turn associated with a frame for pivoting and supporting two or more wheels.

The device comprises a rod member connected to the quarter. The rod member can slide with respect to the shell, and is arranged above a braking element at one end. The braking element is articulated to the frame so that it can oscillate and interact selectively with the ground.

The rod member constrains the movement between the quarter and the braking element, which is constituted by a support for a brake whereon a rubber block that acts on the ground is connected.

The rod member, which connects the quarter to the brake support, can be likened to a linkage, since it is generally affected by a compressive stress; this forces the designer to use a rigid element, otherwise the rod member would bend without transmitting the force applied by the quarter.

The shapes and dimensions of the rod member must be studied as a function of the specific use and of the corresponding stresses to which it will be subjected during sports practice, taking also into account any accidental lateral impacts that it may suffer, increasing design costs and therefore the overall cost of the skate.

Finally, the aesthetic configuration of the skate is considerably worsened by the presence of the rod member located in the rear region of the skate.

EP-A-0600274 discloses a braking device comprising a traction element that connects the quarter to a braking element, so as to allow to achieve braking when a stress is applied to the quarter. The traction element is constituted by an actuation cable.

Due to braking stability reasons, the action of the braking element on the ground must be provided in the region lying to the rear of the frame. Furthermore, in order to allow the rotation of the quarter to tension the actuation cable and therefore allow the action of the brake on the ground, the cable must pass in front of the rotation point of the cuff on the shell.

This braking device has drawbacks; the location of the actuation cable in the front lateral region of the skate entails constructive and aesthetic constraints for the manufacture of said skate.

The actuation cable might in fact be inserted in a sheath that is fixed to the shell by appropriate means: in this case, however, the length of the sheath would have to be limited in any case, in order to allow the quarter to rotate with respect to the shell, and it would therefore be necessary to leave a portion of the cable exposed that could be damaged during sports practice.

As an alternative, the seat for the cable might be provided directly on the walls of the shell of the skate; however, in this case the thickness of the shell should be increased, thus increasing its rigidity in the median region of the foot, in contrast with the requirement of having a certain softness in order to allow the user to practice the sport in the best manner.

Another drawback that can be observed in the prior art resides in the fact that the presence of the rod member located in the rear region of the quarter can be a hindrance during sports practice and particularly when, especially in freestyle skating, one skate is passed behind the other.

SUMMARY OF THE INVENTION

The aim of the present invention is therefore to solve the described problems, eliminating the drawbacks of the mentioned prior art, thus providing a braking device that does not have a connecting element, between the quarter and the brake support, similar to a linkage as described above.

Within the scope of this aim, an important object is to provide a braking device that allows sports practice, particularly freestyle skating, in safety conditions.

Another important object is to provide a device that allows to obtain a skate in which the shell is not excessively rigid, so as to facilitate the movements of the user during sports practice.

Another object is to provide a device that is structurally simple and easy to industrialize.

Another object is to provide a braking device that associates with the above characteristics that of being reliable and safe in use and having low manufacturing costs.

This aim, these objects, and others which will become apparent hereinafter are achieved by a roller skate comprising a quarter articulated to a shell that is in turn associated with a frame supporting a plurality of wheels, a support for a brake being connected to said frame in a rearward region, said brake interacting selectively with a braking surface upon a backward rotation imparted to said quarter, characterized in that it comprises a guide means associated with a flexible actuator means, said actuator means being connected to said quarter and to said support so that, when said quarter is rotated backwards, a compressive thrust is produced on said flexible actuator means which, by sliding along said guide means, moves said brake into contact with said braking surface.

BRIEF DESCRIPTION OF THE DRAWINGS

Further characteristics and advantages of the invention will become apparent from the following detailed description of some particular embodiments thereof, illustrated only by way of non-limitative example in the accompanying drawings, wherein.

DESCRIPTION OF THE PREFERRED EMBODIMENTS

Figure 1:
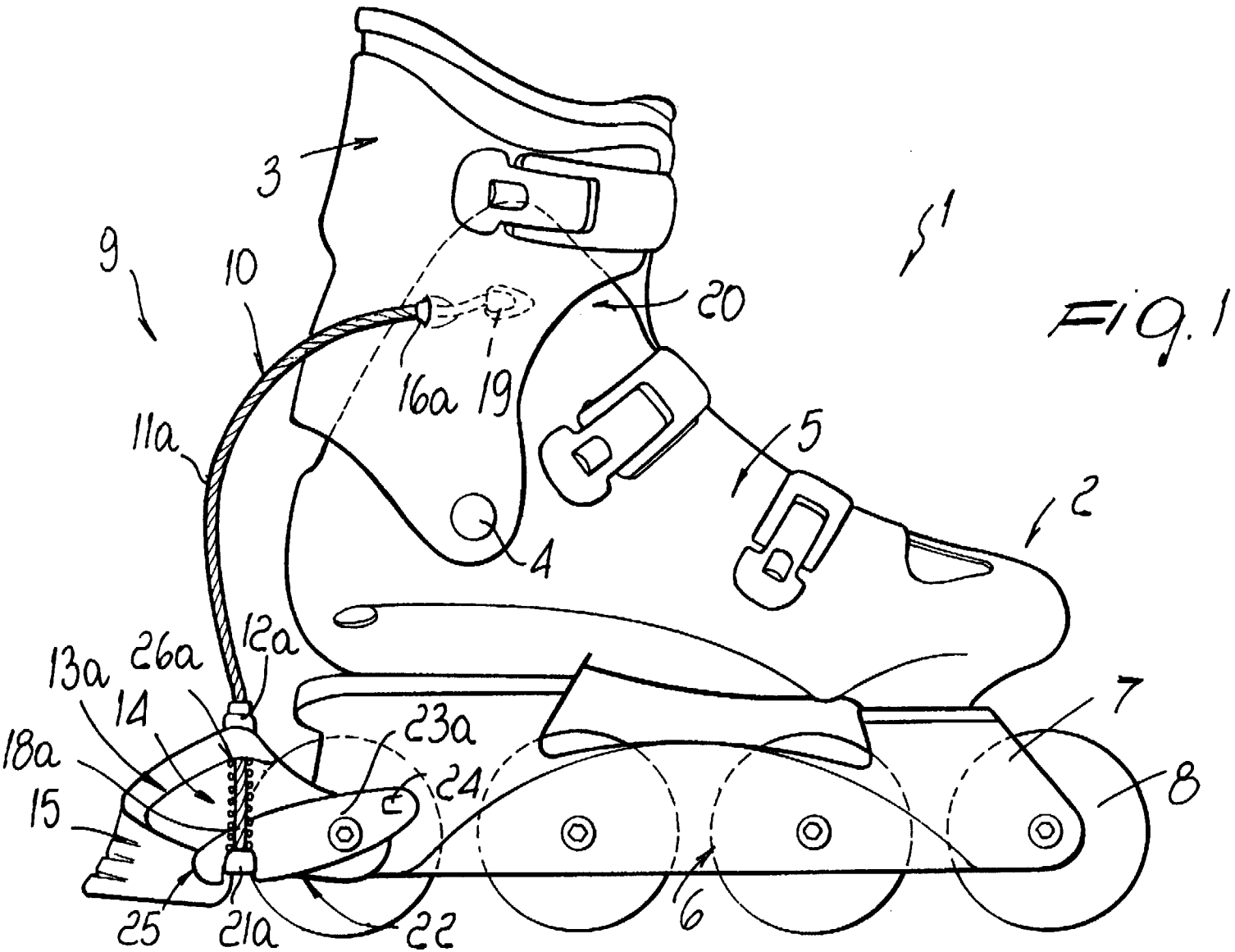
FIG. 1 is a side view of a skate with the braking device associated therewith.

With reference to the above figures, the reference numeral 1 designates a skate constituted by a shoe 2 composed of a quarter 3 that is articulated, at an adapted pair of studs 4, at a shell 5. Shell 5 is associated, with an adapted frame, having wings 7 supporting a plurality of in-line wheels 8.

Figure 2:
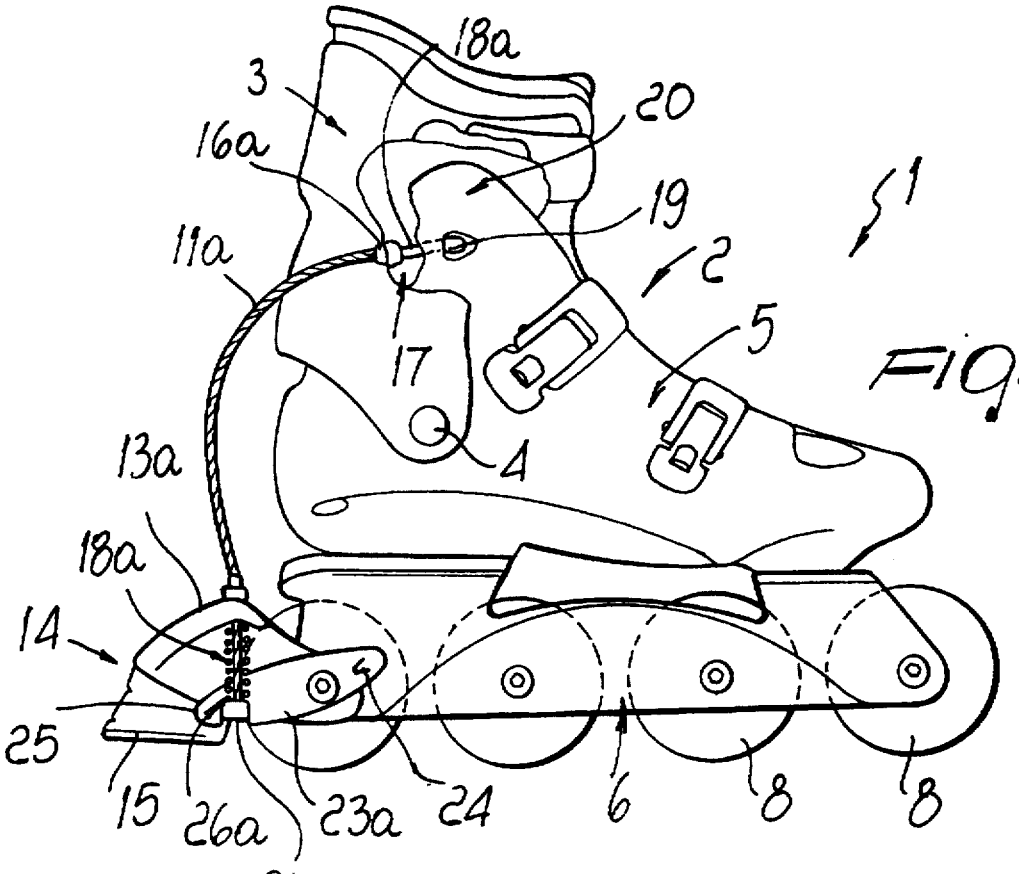
FIG. 2 is a view, similar to FIG. 1, of the skate with the quarter shown in partial cross-section.
Figure 3:
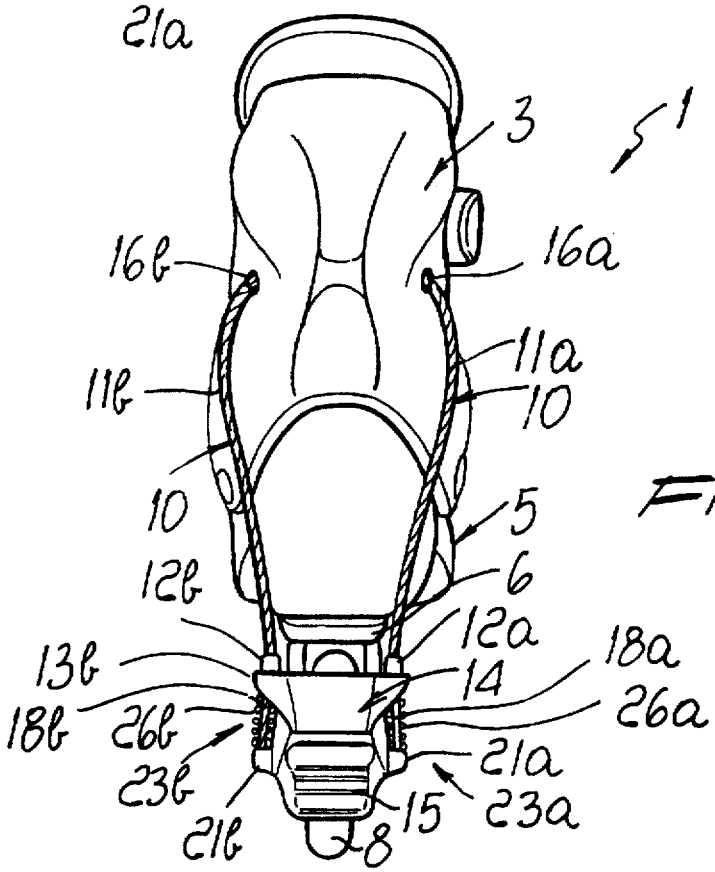
FIG. 3 is a rear view of the skate.

The reference numeral 9 designates the braking device, constituted by at least one actuator 10 which, in the particular embodiments shown in FIGS. 1, 2, and 3, is constituted by two flexible elements, such as sheaths 11*a* and 11*b*, the first ends 12*a* and 12*b* whereof are rigidly coupled at lateral tabs 13*a* and 13*b* of a support 14 for a brake 15 that is connected to the frame. In the illustrated embodiment, support 14 is freely rotatably associated at the pivoting axis of the last rear wheel 8.

Each pair of sheaths 11*a* and 11*b* has second ends 16*a* and 16*b* that are rigidly coupled at the lateral surfaces of the quarter 3 in a region that preferably lies above the studs 4.

The device is also constituted by a guiding element 17 which, in the embodiment shown in FIGS. 1, 2, and 3, is constituted by two cables 18*a* and 18*b*.

The two sheaths 11*a* and 11*b* are slidingly associated on the outside of the two cables 18*a* and 18*b*, which protrude beyond the first and second ends of the two sheaths 11*a* and 11*b*.

Cables 18*a* and 18*b* have third ends 19 which, by protruding from the second ends 16*a* and 16*b*, pass inside the cuff 3 to be locked at the lateral surfaces 20 of the shell 5 in a region lying above the studs 4.

The cables 18*a* and 18*b* have, on the opposite side, fourth ends 21*a* and 21*b* that pass through holes formed on the lateral tabs 12*a* and 13*b* of the support 14 and are associated at an adapted abutment element 22.

In the particular embodiment shown in FIGS. 1, 2, and 3, the abutment element is constituted by two plates 23*a* and 23*b* that are pivoted at the pivot of the last rear wheel 8. A fifth end 24 of said plates is directed towards the shoe 2 and is rigidly coupled at the respective wing 7 and at the frame 6.

Each plate 23*a* and 23*b* has a sixth end 25 that is directed towards the brake 15 and proximate to which the fourth end 21*a* and 21*b* of the cables 18*a* and 18*b* is associated.

A flexible means, constituted by two springs 26*a* and 26*b* arranged coaxially to the cables 18*a* and 18*b*, is advantageously interposed between the lateral tabs 13*a* and 13*b* of the support 14 and the plates 23*a* and 23*b*.

Use of the invention is as follows: if, during sports practice, the skater pushes the cuff backwards, a compressive thrust is produced on the actuator 10 and therefore on the two sheaths 11*a* and 11*b*; in this manner, the two sheaths 11*a* and 11*b*, by sliding along the cables 18*a* and 18*b*, which act as guiding elements, push the support 14 towards a braking surface constituted for example by the ground, until the brake 15 interacts with the surface.

If the user returns the quarter 3 to an upright position or moves it forwards, the two sheaths 11*a* and 11*b* force the support 14 to rise, facilitated by the springs 26*a* and 26*b*.

It has thus been observed that the invention has achieved the intended aim and objects, a braking device having been provided which allows to achieve braking quickly and easily, despite the absence of an element having the functions and characteristics of a rigid linkage.

The lack of a rigid linkage facilitates the passing of one skate behind the other, for example during freestyle skating, and also allows to avoid possible breakages caused by accidental impacts.

Since a compressive thrusting action on the support 14 is achieved by placing the elements in the rear region of the skate, it is possible to use a shell having limited rigidity, since differently from the prior art one avoids locating those elements in the front region of the skate.

The lack of the element having linkage-like characteristics also allows to improve the aesthetic appearance of the skate.

The braking device according to the invention is of course susceptible of numerous modifications and variations, all of which are within the scope of the same inventive concept.

Figure 4:
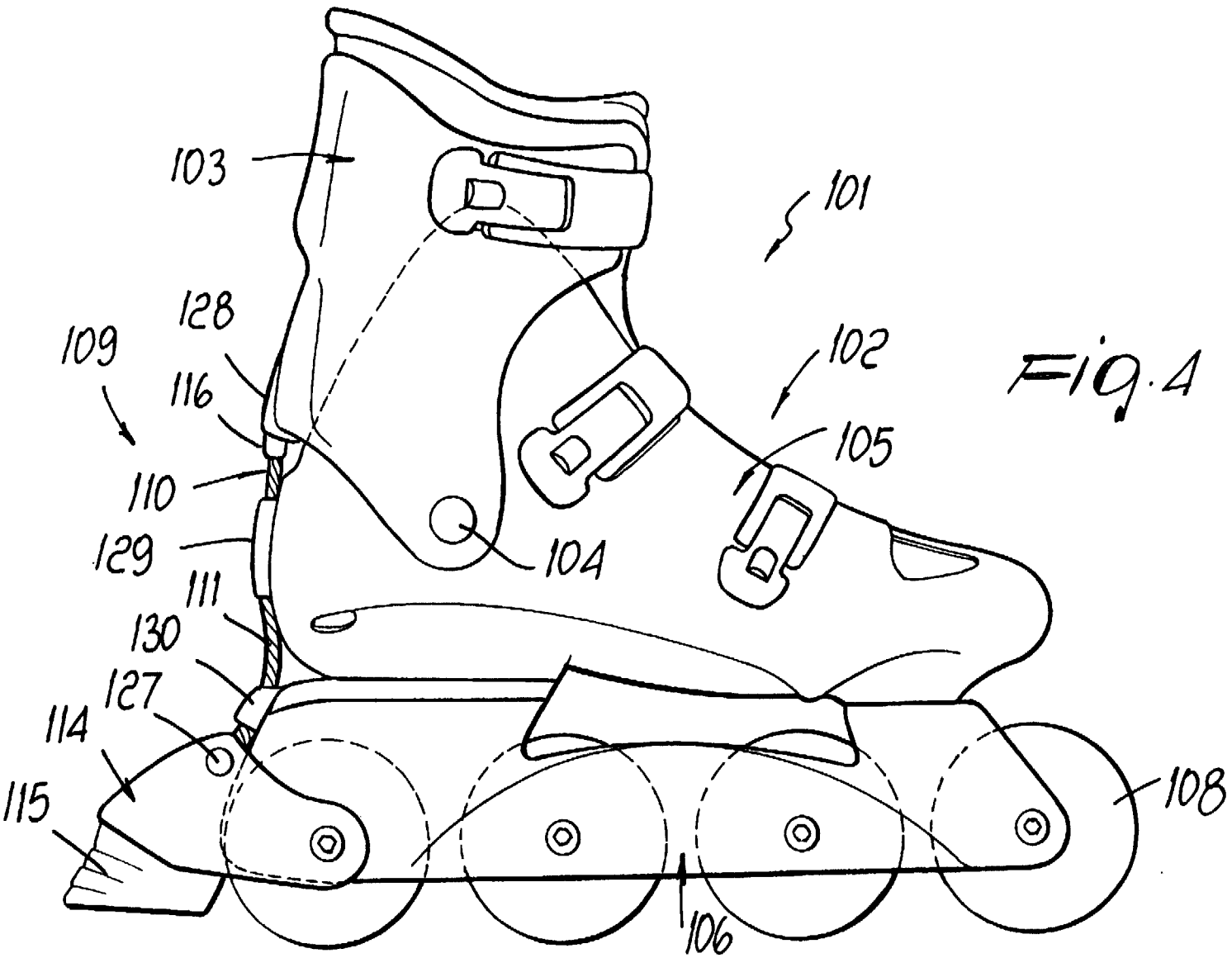
FIG. 4 is a view, similar to FIG. 1, of another embodiment.
Figure 5:
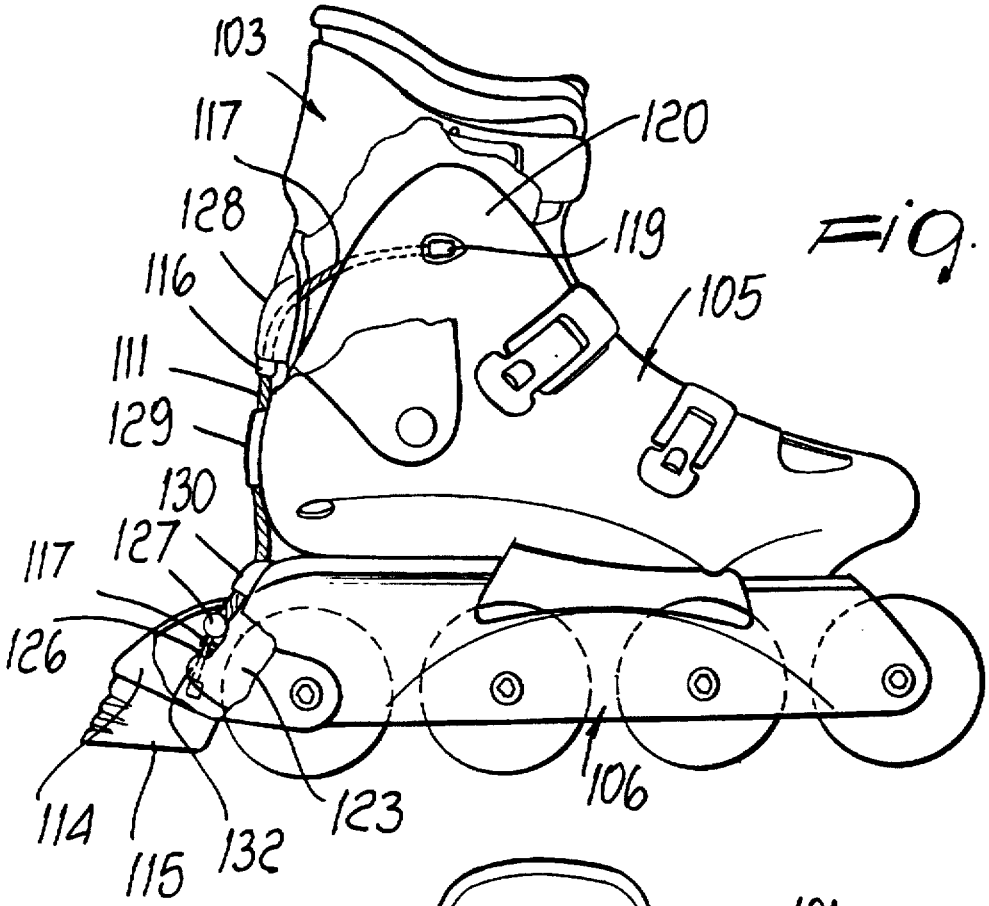
FIG. 5 is a view, similar to FIG. 2, of the embodiment of FIG. 4.
Figure 6:
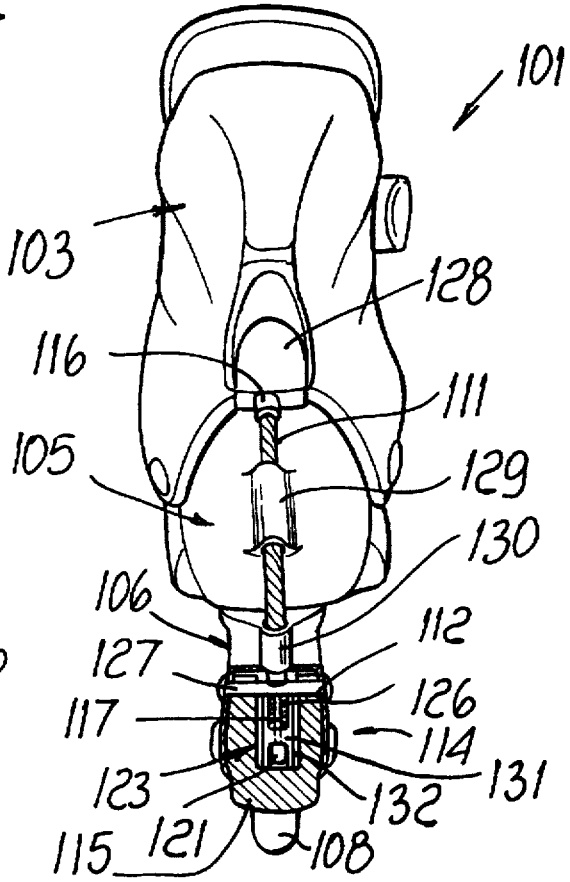
FIG. 6 is a rear view of the skate of FIG. 4.

Thus, for example, FIGS. 4, 5, and 6 illustrate a second embodiment for a skate 101, which is again composed of a shoe 102 comprising a quarter 103 that is pivoted, by means of two studs 104, to a shell 105 that is associated, in a downward region, at an adapted frame 106 between which in-line wheels 108 are pivoted.

A support 114 for a brake 115 is connected, for example rotatably pivoted, to the rear of the frame 106, at the pivot of the last rear wheel 108.

The device, generally designated by the reference numeral 109, is again constituted by an actuator 110 that is constituted by a flexible element, such as a sheath 111, having a first end 112 associated at an adapted pivot 127 that is interposed transversely with respect to the support 114 on the opposite side with respect to the brake 115.

The sheath 111 also has a second end 116 that is rigidly coupled at a locking element 128 associated at the rear region of the quarter 103.

The locking element 128 is internally hollow and is connected to the inside of the quarter 103.

The sheath 111 is advantageously accommodated at a first sleeve 129 and at a second sleeve 130 that protrude longitudinally and to the rear of the shell 105 and of the support 114 respectively.

The device 109 also comprises a guiding element 117 constituted by a cable that passes through a hole formed on the pivot 127 and inside the locking element 128 and the quarter 103.

The cable also has a third end 119 that is rigidly coupled at the right or left lateral surface 120 of the shell 105.

The cable also has a fourth end 121 that is rigidly coupled at an adapted plate 123 arranged inside the support 114.

The sheath 111 is slidingly associated on the outside of the cable 117, which protrudes beyond the ends of the sheath 111.

The fourth end 121 of the cable abuts at the bridge 131 10 that joins the wings 132 of the plate 123, whereas a flexible means, such as a spring 126 arranged coaxially with respect to said cable and adapted to facilitate the return of the support 114 in a non-braking position once the quarter 103 has been returned to the vertical position, is interposed between said bridge 131 and the facing pivot 127.

This solution, too, allows to achieve the intended aim and objects.

Figure 7:
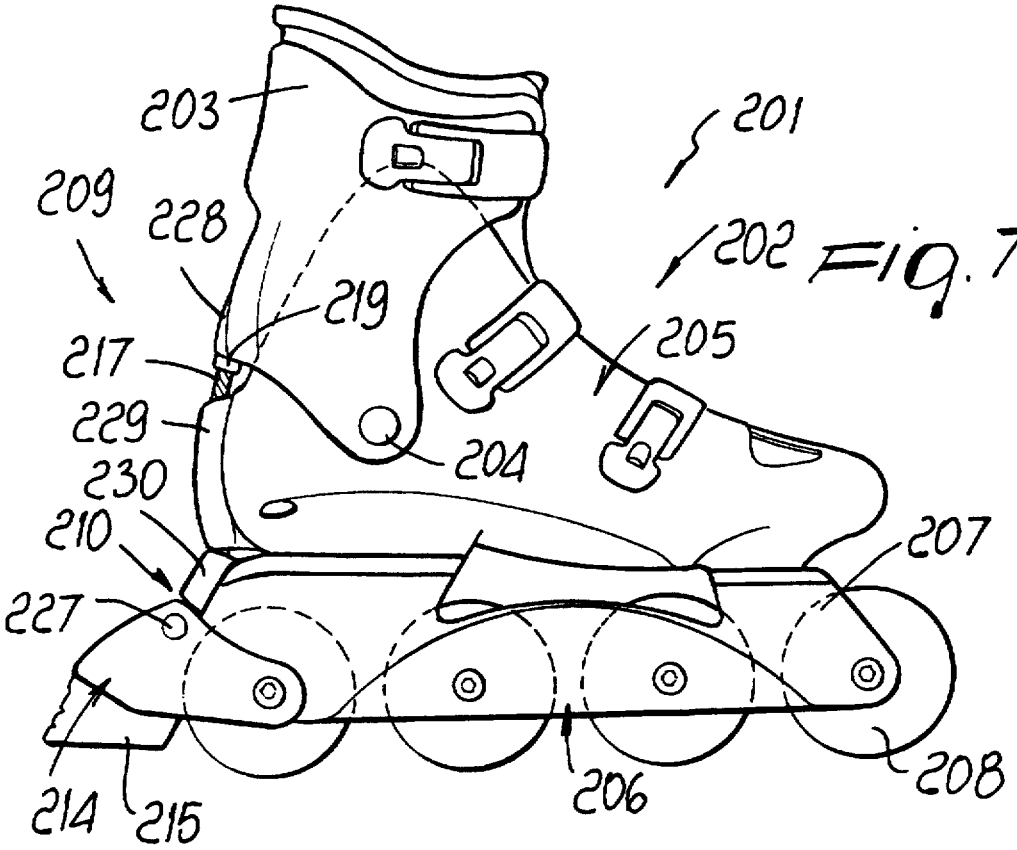
FIG. 7 is a side view of a further embodiment of the skate.
Figure 8:
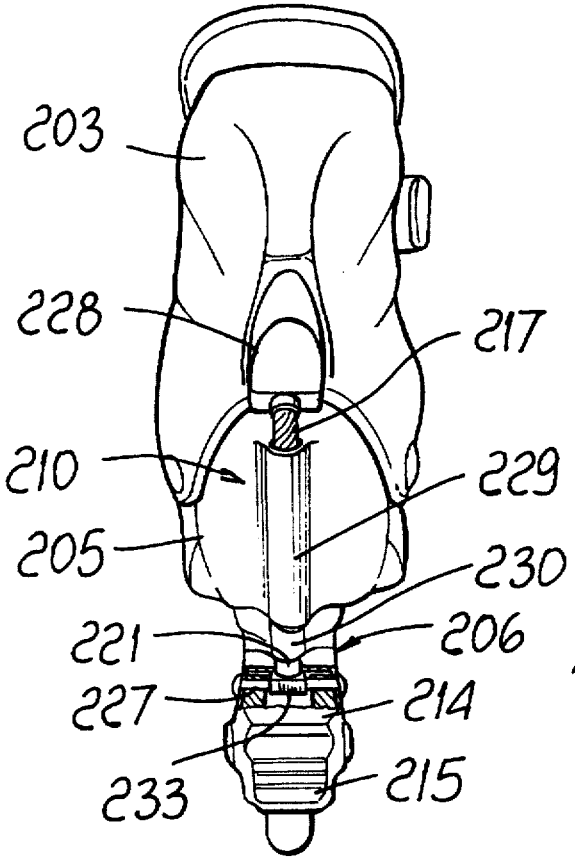
FIG. 8 is a rear view of the skate of the preceding figure.

FIGS. 7 and 8 illustrate a further embodiment for a skate 201 that is constituted by a shoe 202 comprising a quarter 203 that is rotatably pivoted, at an adapted pair of studs 204, to a shell 205 that is in turn associated, in a downward region, at a frame 206, between the wings 207 whereof a plurality of in-line wheels 208 are freely pivoted.

A support 214 for a brake 215 is connected to the rear of the frame 206, for example pivoted at the axle of the last rear wheel.

The braking device 209 is constituted by at least one guiding element 210 comprising for example a first sleeve 229 and a second sleeve 230 that are arranged to the rear and approximately longitudinally to the shell 205 and to the frame 206, respectively, and in a region above the support 214 as regards said frame 206.

The braking device 209 also comprises an actuator 217 comprising a steel cable of appropriate size that is slidingly associated at the first and second sleeves and has a third end 219 that is rigidly coupled at a locking element 228 associated in a rearward region with respect the quarter 203 in a region lying above the first sleeve 229.

The cable has a fourth end 221 that is rigidly coupled at an adapted bush 233 arranged coaxially to a pivot 227 that is transversely associated at the support 214.

As an alternative, the guiding element can be constituted by a single sleeve that is preferably associated with the shell.

In this solution, too, a backward movement of the quarter produces the sliding of the cable 217 inside the first and second sleeves and therefore a rotation of the support 214, with a consequent interaction of the brake 215 with a braking surface, such as the ground.

Figure 9:
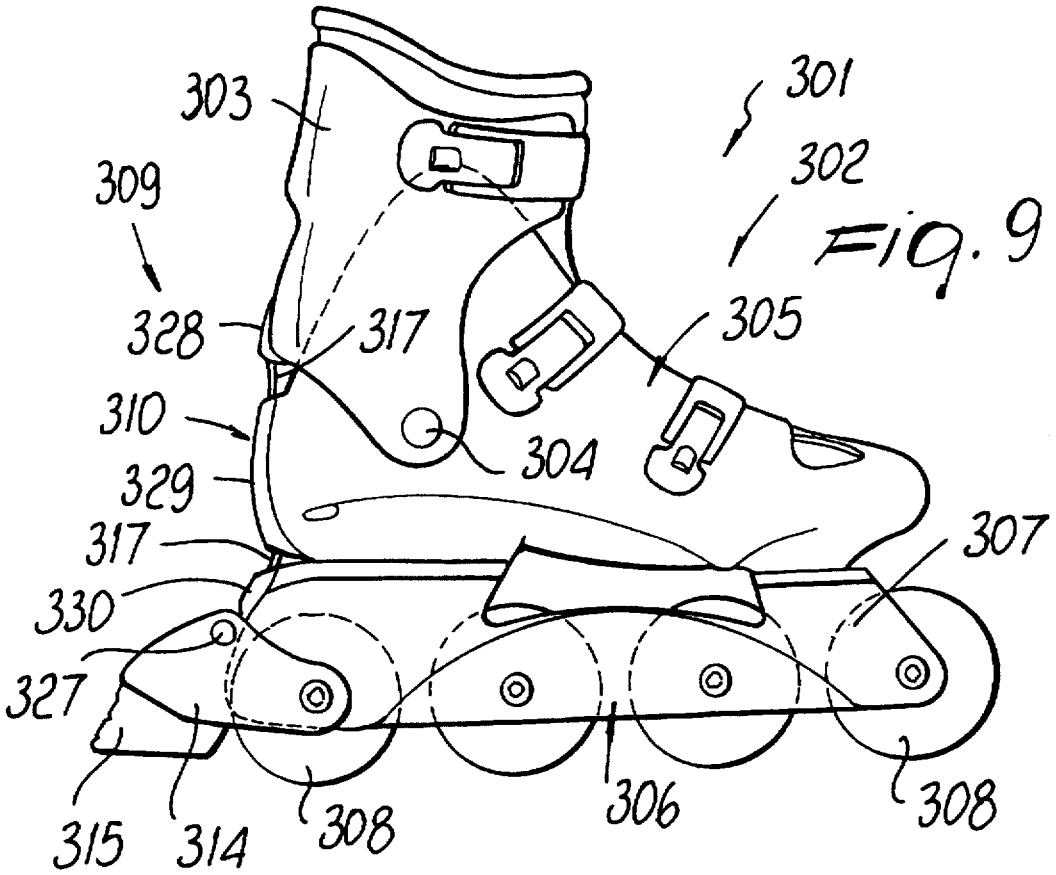
FIG. 9 is a side view of a further embodiment of the skate.
Figure 10:
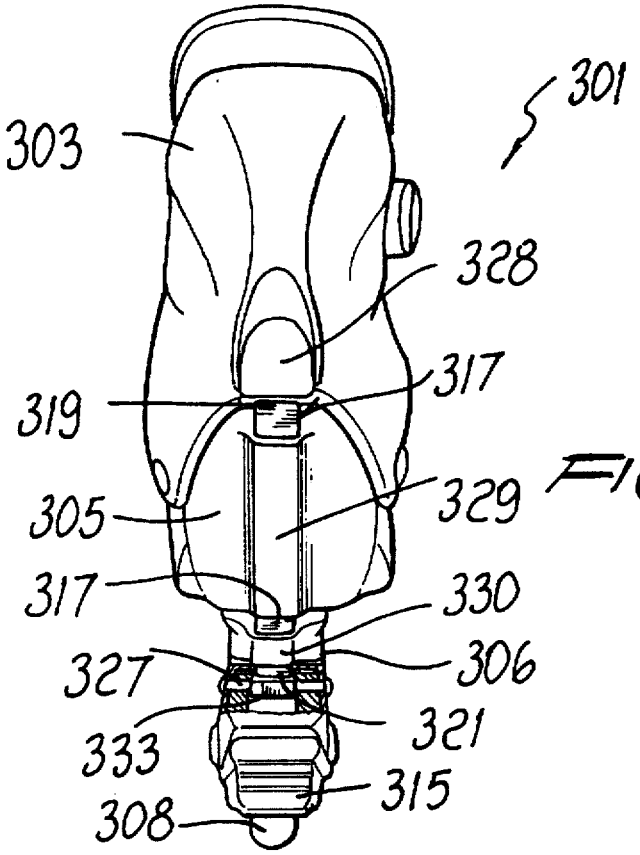
FIG. 10 is a rear view of the skate of FIG. 9.

FIGS. 9 and 10 illustrate a further embodiment of a skate 301, which is again constituted by a shoe 302 comprising a quarter 303 that is rotatably pivoted, by means of two studs 304, at a shell 305.

The shell is associated, in a downward region, at an adapted frame 306, between the wings 307 whereof a plurality of in-line wheels 308 are freely rotatably pivoted.

A support 314 for a brake 315 is connected at the last rear wheel, preferably at the pivoting axis.

The braking device, generally designated by the reference numeral 309, is constituted by at least one guiding element 310 comprising, for example, a first sleeve 329 and a second sleeve 330 that are formed at the rear along an axis that lies longitudinally to the shell 305 and to the frame 306, respectively, and in a region above the support 314 as regards said frame 306.

An actuator 317 is slidingly associated inside the first and second sleeves and is constituted by a blade having a third end 319 that is rigidly coupled at a locking element 328 associated in a rearward position with the quarter 303 in a region lying above the first sleeve 329.

The blade also has a fourth end 321 that is rigidly connected to a bush 333 arranged coaxially to an adapted pivot 327 that is transversely associated with the support 314 for the brake 315.

As an alternative, the guiding element can be constituted by a single sleeve that is preferably associated with the shell.

In this case, too, this solution allows to achieve the intended aim and objects, by specifically providing an even ore compact skate shape, so as to improve safety in use due to the lack of elements protruding from the profile of said skate and provide a more pleasant aesthetic appearance because said elements are missing.

The materials and the dimensions constituting the individual components of the structure may of course be the most pertinent according to the specific requirements.

What is claimed is:

1. In a skate comprising a frame supporting a plurality of wheels, a shell mounted above said frame, a quarter articulated to said shell, a brake, and a support for said brake, said brake interacting selectively with a braking surface upon a backward rotation of said quarter, the improvement comprising a first sleeve and a second sleeve, said first sleeve and said second sleeve located in a region in the rear of said skate along an axis lying longitudinally to said shell and said frame, respectively, and in a region above said support, a blade engaged by said first and second sleeves and having a first end attached to said quarter in a region lying above said first sleeve and to the rear of said quarter and a second end attached to said support, whereby when said quarter is rotated backwards, a compressive thrust is produced on said blade which, by being guided by and restrained from bending by said first and second sleeves, moves said brake into contact with said braking surface.

2. The roller skate according to claim 1, wherein the second end of said blade is attached to a bushing arranged coaxially to an adapted pivot that is transversely associated with said support for said brake.

3.In a skate comprising a frame supporting a plurality of wheels, a quarter articulated for forward and rearward pivotal movement relative to the frame, a braking element movable generally upwardly and downwardly relative to the frame between a first position in which the braking element engages a braking surface and a second position in which the braking element is spaced from the braking surface, and a longitudinally-extending actuator having a first end and a second end, the first end being operatively responsive to pivoting movement of the quarter and the braking element being operatively responsive to a movement of the second end such that the actuator causes the braking element to move downwardly in response to rearward pivotal movement of the quarter, that improvement wherein:

the actuator is flexible; and the skate includes a longitudinally-extending guide attached to the skate; and engaging the actuator over a portion of the longitudinal length thereof such that when the rearward pivotal movement of the quarter applies a compressive force to the actuator and forces the braking element downwardly into engagement with the braking surface the guide prevents the actuator from bending in response to the applied compressive force.

4. A skate according to claim 3, wherein said actuator moves along a path defined by said guide upon said rearward pivotal movement of said quarter.

5. A skate according to claim 3, wherein said guide defines at least one longitudinally-extending aperture and said actuator extends through said at least one aperture.

6. A skate according to claim 5, wherein said actuator comprises a blade.

7. A skate according to claim 3, wherein the length of said actuator engaged by said guide is greater than the length of said actuator not engaged by said guide.

8. A skate according to claim 3, wherein said guide comprises a pair of longitudinally-extending guide portions, said guide portions being longitudinally spaced from each other, each of said guide portions engaging a portion of said actuator.

9. A skate according to claim 3, wherein said actuator defines a longitudinally-extending aperture and said guide extends through said aperture.

10. A skate according to claim 9, wherein said guide comprises a cable.

11. A skate according to claim 10, wherein said actuator comprises a sheath.

* * * * *